US011072920B2

(12) United States Patent
Shinomiya et al.

(10) Patent No.: US 11,072,920 B2
(45) Date of Patent: Jul. 27, 2021

(54) FLUSH TOILET

(71) Applicant: TOTO LTD., Kitakyushu (JP)

(72) Inventors: Akira Shinomiya, Kitakyushu (JP); Hiroshi Hashimoto, Kitakyushu (JP); Takashi Ogami, Kitakyushu (JP); Takumi Tsuchitani, Kitakyushu (JP); Isami Sakaba, Kitakyushu (JP); Haruka Saito, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 11 days.

(21) Appl. No.: 16/543,339

(22) Filed: Aug. 16, 2019

(65) Prior Publication Data

US 2020/0063426 A1 Feb. 27, 2020

(30) Foreign Application Priority Data

Aug. 23, 2018 (JP) ..... JP2018-156464
Feb. 22, 2019 (JP) ..... JP2019-030639

(51) Int. Cl.
*E03D 11/17* (2006.01)

(52) U.S. Cl.
CPC ..... *E03D 11/17* (2013.01)

(58) Field of Classification Search
CPC ..... E03D 11/13; E03D 11/02; E03D 11/08; E03D 11/17; E03D 11/18
See application file for complete search history.

(56) References Cited

U.S. PATENT DOCUMENTS 2,616,094 A * 11/1952 Cramer ..... E03D 11/08 4/428
4,232,410 A 11/1980 Forsback et al.
(Continued)

FOREIGN PATENT DOCUMENTS

CA 2163149 A1 5/1997
JP 2016-176255 A 10/2016
JP 2017-031772 A 2/2017

OTHER PUBLICATIONS

An Office Action issued by the China National Intellectual Property Administration dated Sep. 1, 2020, which corresponds to Chinese Patent Application No. 201910748024.8 and is related to U.S. Appl. No. 16/543,339 with English language translation.
(Continued)

*Primary Examiner* — Janie M Loeppke
(74) *Attorney, Agent, or Firm* — Studebaker & Brackett PC

(57) ABSTRACT

A flush toilet of the present invention includes a bowl portion for receiving waste and a discharge trap conduit connected to a lower portion of the bowl portion and extending to a discharge opening. The discharge trap conduit includes an ascending conduit ascending rearward from the lower portion of the bowl portion and a descending conduit descending from a downstream end of the ascending conduit to the discharge opening. The descending conduit includes a bottom surface on a rear side of the discharge opening, and a ceiling sloping surface, an upper end of the ceiling sloping surface being formed integrally with a bottom surface of a top portion of the ascending conduit, the ceiling sloping surface being formed on a front side of the discharge trap passage, and the ceiling sloping surface being inclined downward and forward from the upper end to a lower end of the discharge trap passage.

9 Claims, 10 Drawing Sheets

(56) References Cited

U.S. PATENT DOCUMENTS

| | | | | |
|---|---|---|---|---|
| 5,404,597 | A * | 4/1995 | Hennessy | E03D 5/00 137/247.29 |
| 9,003,575 | B2 * | 4/2015 | Mesun | E03D 11/18 4/428 |
| 9,045,890 | B2 * | 6/2015 | Kuru | E03D 11/08 |
| 2004/0139538 | A1 * | 7/2004 | Kuru | E03D 11/18 4/420 |

OTHER PUBLICATIONS

An Office Action; "Notice of Reasons for Refusal," mailed by the Japanese Patent Office dated Sep. 10, 2020, which corresponds to Japanese Patent Application No. 2019-030639 and is related to U.S. Appl. No. 16/543,339 with English language translation.

* cited by examiner

FLUSH TOILET

BACKGROUND OF THE INVENTION

Field of the Invention

The present invention relates to a flush toilet, and more particularly to a flush toilet that includes: a bowl which receives waste; and a discharge flow passage which is connected to a lower portion of this bowl and extends to a discharge opening connected to an inlet of an external water discharge conduit and a part of which stores sealing water.

Description of the Related Art

If wastewater discharged from a toilet main body flows into the discharge opening at a time, a discharge trap conduit or water discharge conduit is temporarily brought into a full water state and this may cause self-siphonage of drawing water in an upstream side in toward a downstream side. When this self-siphonage occurs, sealing water within the toilet main body is drawn in toward the downstream side and discharged; and this may cause shortage of sealing water.

In order to prevent such a self-siphonage, for example, flush toilets as described in Japanese Patent Laid-Open No. 2016-176255 and Japanese Patent Laid-Open No. 2017-31772 have been proposed. Japanese Patent Laid-Open No. 2016-176255 describes a flush toilet that includes a discharge socket for connecting a discharge opening of a toilet main body and a water discharge conduit arranged on a floor surface. The discharge socket of this flush toilet includes a flow-dividing portion at its inflow portion, in which wastewater having flowed in is made to collide with the flow-dividing portion to be divided into upward and downward directions; and the wastewater having been divided into the upward direction is made to swirl in a swirling space. Thus, the maximum instantaneous flow rate of the wastewater to be discharged from the discharge socket to the water discharge conduit is reduced and the occurrence of self-siphonage in the water discharge conduit is suppressed.

In addition, Japanese Patent Laid-Open No. 2017-31772 describes a flush toilet that includes a discharge trap conduit. A discharge trap conduit of this flush toilet includes a descent conduit. This descent conduit includes: an expansion portion in which the cross-sectional area of a flow passage is successively expanded; a contraction portion provided on the downstream side of the expansion portion, in which the cross-sectional area of the flow passage is contracted; and a water receiving portion between the expansion portion and the contraction portion. In addition, a recessed portion is formed by the expansion portion and the water receiving portion. In this flush toilet, the flow speed of flush water flowing through the descent conduit is delayed by this recessed portion, thereby suppressing the occurrence of self-siphonage.

SUMMARY OF THE INVENTION

As described above, various structures for suppressing the occurrence of self-siphonage have been proposed; however, it is desired to develop a flush toilet in which those structures have been further improved.

The present invention has been made so as to meet such conventional demands, and it is an object of the present invention to provide a flush toilet that can suppress the occurrence of self-siphonage, thereby to surely suppress sealing water from being drawn in toward a downstream side.

In order to achieve the above object, the present invention provides a flush toilet comprising: a bowl portion for receiving waste; and a discharge flow passage connected to a lower portion of the bowl portion and extending to a discharge opening connected to an inlet of an external water discharge conduit, a part of the discharge flow passage storing sealing water; wherein the discharge flow passage includes an ascending flow passage ascending rearward from the lower portion of the bowl portion and a descending flow passage descending from a downstream end of the ascending flow passage to the discharge opening, and the descending flow passage of the discharge flow passage includes a bottom surface on a rear side from the discharge opening, and a ceiling sloping surface formed on a front side of the discharge flow passage, an upper end of the ceiling sloping surface being formed integrally with a bottom surface of the top portion of the ascending flow passage, and the ceiling sloping surface being inclined downward and forward from the upper end to a lower end thereof.

In the present invention thus configured, a part of wastewater flowing on the bottom surface of the top portion of the ascending flow passage of the discharge flow passage flows along the ceiling sloping surface of the descending flow passage according to a Coanda effect (a phenomenon in which a jet flow is bent along an individual wall) and flows into the discharge opening from the front side of the discharge opening rearward. On the other hand, the remainder of the wastewater flows along the bottom surface of the descending flow passage and flows into the discharge opening from the rear side toward the front side. As a result, according to the present invention, a flowing direction of the wastewater flowing into the discharge opening can be dispersed to at least directions from the front side and from the rear side. Accordingly, self-siphonage can be suppressed from occurring within the discharge flow passage and the water discharge conduit. Thus, the present invention can suppress the sealing water in the flush toilet from being drawn in toward the downstream side.

In the present invention, preferably, the discharge flow passage includes a concave portion formed from the bottom surface of the top portion of the ascending flow passage to at least an upstream side of the ceiling sloping surface of the descending flow passage.

In the flush toilet of the present invention thus configured, the concave portion is formed from the bottom surface of the top portion of the ascending flow passage to at least the upstream side of the ceiling sloping surface of the descending flow passage. Accordingly, compared with the case of a flat surface, a contact area, in contact with the wastewater on the ceiling sloping surface of the descending flow passage, increases. As a result the Coanda effect easily occurs on the bottom surface of the top portion of the ascending flow passage to the ceiling sloping surface of the descending flow passage. Consequently, an amount of the wastewater flowing along the sloping surface increases. The flowing direction of the wastewater flowing into the discharge opening can be further dispersed in the descending flow passage of the discharge flow passage.

In the present invention, preferably, the discharge flow passage includes left and right side surfaces, and the left and right side surfaces are respectively formed to substantially perpendicularly extend in an up-down direction from left and right side portions of the bottom surface of the top portion of the ascending flow passage to left and right side portions of the descending flow passage.

In the present invention thus configured, the left and right side surfaces of the discharge flow passage are respectively formed to substantially perpendicularly extend in the up-down direction from the left and right side portions of the bottom surface of the top portion of the ascending flow passage to the left and right side portions of the descending flow passage. Accordingly, it is easy to form a flow along the left and right side surfaces of the discharge flow passage according to the Coanda effect. Consequently, a flowing distance of the wastewater flowing on the left and right side surfaces and a distance of the wastewater flowing on the ceiling sloping surface are different and timings of the wastewater flowing into the discharge opening are different. Thus, the wastewater flowing into the discharge opening can be temporally dispersed.

In the present invention, preferably, the ceiling sloping surface of the descending flow passage includes an upstream ceiling sloping surface and a downstream ceiling sloping surface, and a curvature radius of a surface connecting the downstream ceiling sloping surface and left and right side surfaces is larger than a curvature radius of a surface connecting the upstream ceiling sloping surface and the left and right side surfaces.

In the present invention thus configured, the curvature radius of the surface connecting the downstream ceiling sloping surface and the left and right side surfaces is larger than the curvature radius of the surface connecting the upstream ceiling sloping surface and the left and right side surfaces. Accordingly, the Coanda effect weakens on the downstream ceiling sloping surface and a part of the wastewater flowing along the downstream ceiling sloping surface flows down along the left and right side surfaces. Thus, according to the present invention, the flowing direction of the wastewater flowing into the discharge opening can be further dispersed.

In the present invention, preferably, the descending flow passage of the discharge flow passage includes a front bottom surface formed between a lower end of the ceiling sloping surface and a front end of the discharge opening.

In the present invention thus configured, the wastewater flowing to the lower end along the ceiling sloping surface of the descending flow passage of the discharge flow passage flows to the discharge opening rearward from the front bottom surface in the front of the discharge opening. Accordingly, occurrence of a flow of a large amount of the wastewater along the front end of the water discharge conduit that occurs when the wastewater flows into the discharge opening forward from the bottom surface can be suppressed. Consequently, according to the present invention, self-siphonage can be suppressed from occurring within the water discharge conduit.

In the present invention, preferably, the descending flow passage of the discharge flow passage further includes: a descending bottom surface inclined downward and rearward from a top portion of the ascending flow passage; and a connecting surface that connects a lower end of the descending bottom surface and the upper end of the ceiling sloping surface of the descending flow passage, and a curvature radius in a vertical cross section in a front-rear direction of the connecting surface is smaller than a curvature radius of the descending bottom surface.

In the present invention thus configured, a flow of flush water can be formed rearward, that is, toward one of the bottom surface of the descending flow passage and an upper region of the bottom surface by the descending bottom surface of the descending flow passage of the discharge flow passage. Furthermore, the curvature radius of the connecting surface of the descending flow passage is smaller than the curvature radius of the descending bottom surface. Accordingly, the flow of the flush water directed to the region on the bottom surface side by the descending bottom surface can be easily peeled from the connecting surface by the connecting surface. As a result, according to the present invention, the flush water flowing along the connecting surface from the descending bottom surface can be easily peeled toward, for example, the upper region of the bottom surface. Self-siphonage can be suppressed from occurring within the discharge flow passage and the water discharge conduit because an amount of the flush water flowing along the ceiling sloping surface from the connecting surface is excessively large.

In the present invention, preferably, the length in the front-rear direction from a front end to a rear end of the connecting surface of the descending flow passage is smaller than the length in the front-rear direction from a front end to a rear end of the descending bottom surface.

According to the present invention thus configured, the length in the front-rear direction from the front end to the rear end of the connecting surface of the descending flow passage is smaller than the length in the front-rear direction from the front end to the rear end of the descending bottom surface. Accordingly, the flush water less easily flows along the connecting surface. The flush water flowing along the connecting surface from the descending bottom surface can be more easily peeled toward, for example, the upper region of the bottom surface. Thus, self-siphonage can be further suppressed from occurring within the discharge flow passage and the water discharge conduit because an amount of the flush water flowing along the ceiling sloping surface from the connecting surface is excessively large.

In the present invention, preferably, the rear end of the connecting surface of the descending flow passage is located further rearward than a center axis of the discharge opening.

According to the present invention thus configured, the flush water peeled from the connecting surface of the descending flow passage easily lands on the bottom surface on the rear side of the discharge opening. Consequently, the flowing direction of the flush water flowing into the discharge opening can be more surely dispersed to at least directions from the front side and from the bottom surface on the rear side. Self-siphonage can be suppressed from occurring within the discharge flow passage and the water discharge conduit.

In the present invention, preferably, a curvature radius of a connecting surface connecting the descending bottom surface and left and right side surfaces of the descending flow passage is larger than a curvature radius of a connecting surface connecting a bottom surface of an ascending portion of the ascending flow passage and the left and right side surfaces.

According to the present invention thus configured, the curvature radius of the connecting surface connecting the descending bottom surface and the left and right side surfaces of the descending flow passage is larger than the curvature radius of the connecting surface connecting the bottom surface of the ascending portion of the ascending flow passage and the left and right side surfaces. Consequently, the height of a water surface from the descending bottom surface of the flush water flowing between the descending bottom surface and the left and right side surface of the descending flow passage is larger than the height of a water surface from the bottom surface of the ascending portion of the flush water flowing between the bottom surface and the left and right side surfaces of the ascending portion of the ascending flow passage. The flow rate of the flush water flowing on the descending bottom surface is higher than the flow rate of the flush water flowing on the bottom surface of the ascending portion of the ascending flow passage. Thus, according to the present invention, the flow of the flush water directed to a region on the bottom surface side by the descending bottom surface can be more easily peeled from the connecting surface.

In the present invention, preferably, the descending flow passage of the discharge flow passage includes a guiding portion formed on the bottom surface thereof, the guiding portion guiding the wastewater flowing horizontally from the bottom surface toward the discharge opening to be directed to either a left or right side of the center of the discharge opening.

According to the present invention thus configured, the guiding portion is formed on the bottom surface of the descending flow passage of the discharge flow passage. The guiding portion guides the horizontal directional flow of wastewater, which flows toward the discharge opening, to be directed to either a left or right side of the center of the discharge opening; and therefore, this guiding portion makes the wastewater, which flows into the discharge opening, easily flow in while deviating from the center of the discharge opening. Accordingly, self-siphonage, otherwise occurring due to wastewater sealing the discharge flow passage (such as a discharge trap) and a part of the water discharge conduit, can be suppressed from occurring within the discharge flow passage and water discharge conduit. Thus, the present invention can further suppress sealing water in the flush toilet from being drawn in toward the downstream side.

Advantageous Effects of Invention

The flush toilet of the present invention can further suppress the occurrence of self-siphonage, thereby being able to surely suppress sealing water from being drawn in toward a downstream side.

DETAILED DESCRIPTION OF THE PREFERRED EMBODIMENTS

First, a basic structure of a flush toilet according to a first embodiment of the present invention will be described with reference to FIG. 1 and FIG. 2.

Figure 1:
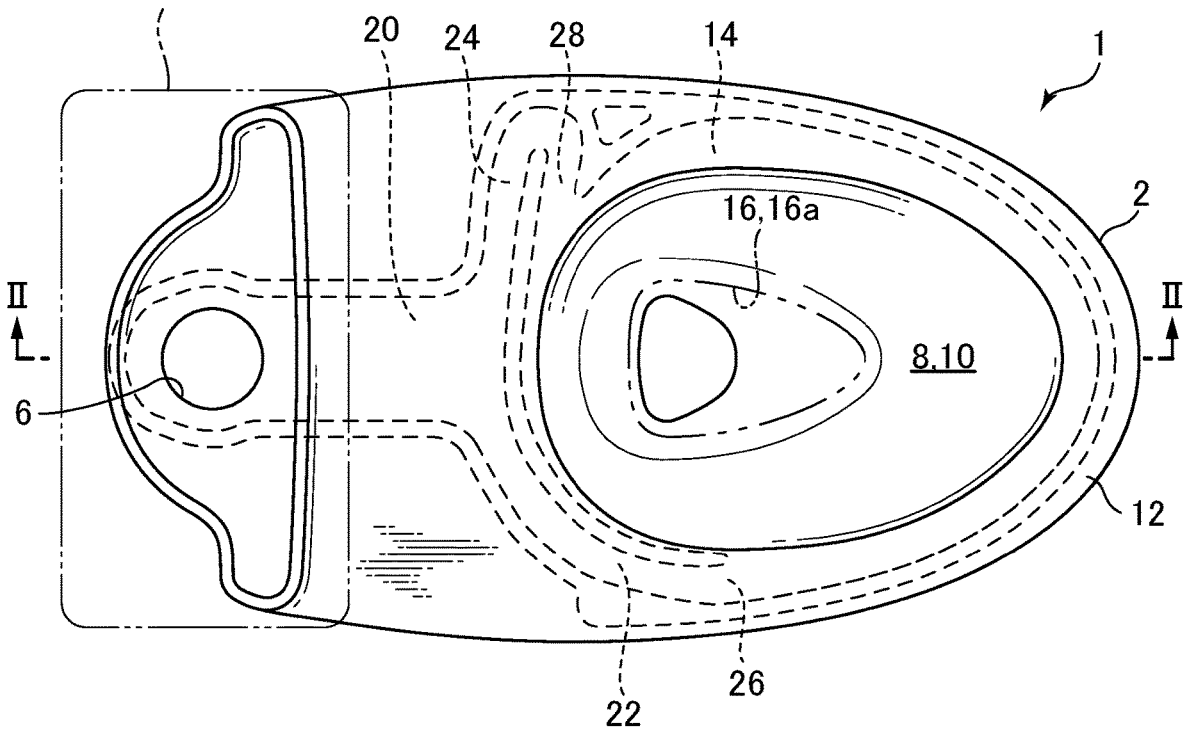
FIG. 1 is a plan view of a flush toilet according to a first embodiment of the present invention.
Figure 2:
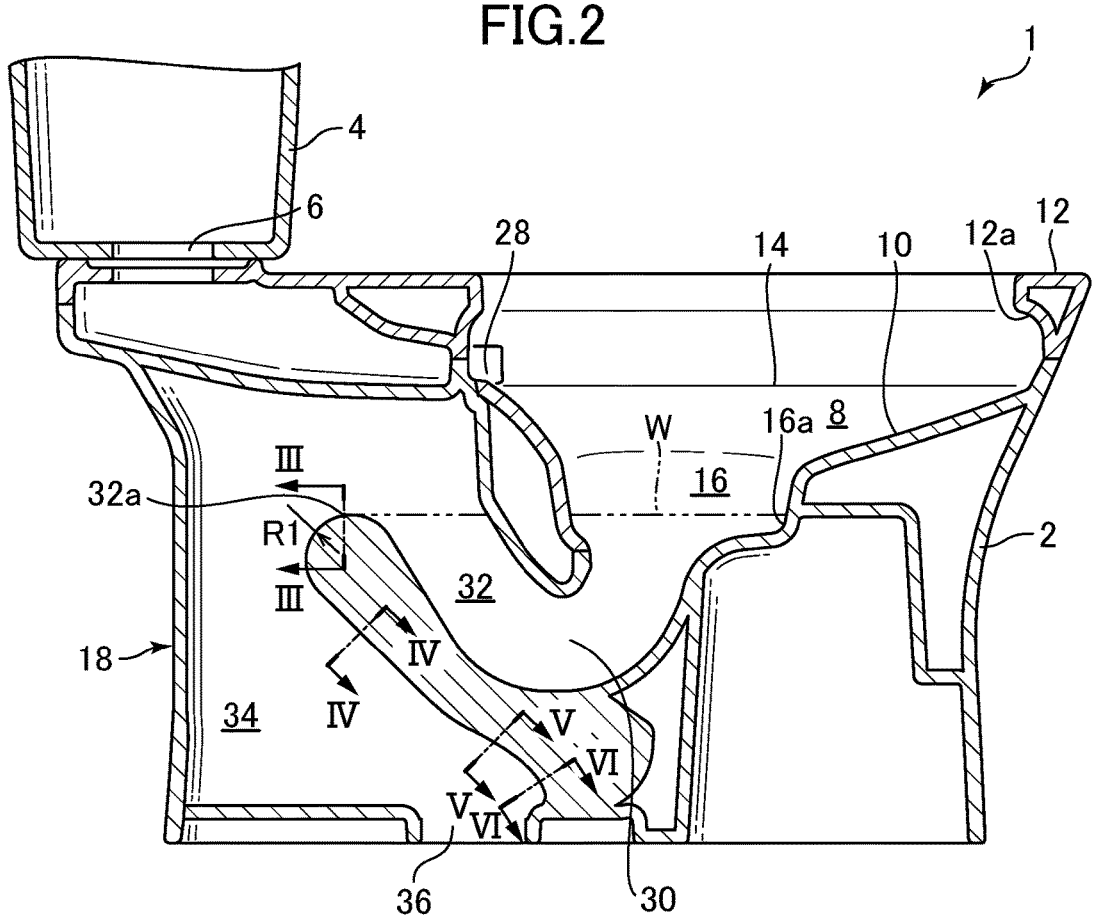
FIG. 2 is a longitudinal sectional view of the flush toilet when viewed along the line II-II in FIG. 1.

As shown in FIG. 1 and FIG. 2, a flush toilet 1 according to the first embodiment of the present invention includes a toilet main body 2 and a storage tank 4 that stores flush water supplied to the toilet main body 2. The toilet main body 2 is entirely made of ceramic. Alternatively, the flush toilet 1 may use other water supply sources (running water, etc.) instead of the storage tank 4.

The storage tank 4 stores approximately 3.6 liters to approximately 4.8 liters of flush water and has a tank discharge opening 6 on its lower surface. When a user operates a switch (not illustrated), a discharge valve (not illustrated) is brought into an open state, and flush water within the storage tank 4 is supplied from the tank discharge opening 6 of the storage tank 4 to the toilet main body 2.

The toilet main body 2 has a bowl portion 8 on its front side, and the bowl portion 8 includes: a bowl-shaped waste receiving surface 10; a rim portion 12 that is formed on an upper rim of this waste receiving surface 10; and a shelf portion 14 that is formed between this waste receiving surface 10 and rim portion 12. On the rim portion 12, an inner circumferential surface 12*a*, which is overhanging toward an inner side, is formed.

The bowl portion 8 in the toilet main body 2 further includes a concave portion 16 that is formed at a lower part of the waste receiving surface 10. This concave portion 16 is formed by a vertical wall portion 16*a* that extends in a substantially vertical direction and is substantially triangle-shaped in a plan view.

On a lower side of the concave portion 16 of the bowl portion 8 of the toilet main body 2, a discharge trap conduit 18 that is a discharge flow passage for discharging waste together with flush water is formed.

The flush toilet 1 according to the embodiment is a "flush-type toilet" that discharges waste by a water-flow action due to the fall of flush water within the bowl portion 8.

On the rear side of the toilet main body 2, a common rim water conduit 20, which extends in the front-rear direction, extends from its rear to its front; and the rear side of it is connected to the tank discharge opening 6 of the storage tank 4 described above, where flush water flows in from the storage tank 4. A front side that is a downstream end of the common rim water conduit 20 branches into a first rim water conduit 22 and a second rim water conduit 24.

On the downstream end of the first rim water conduit 22, a first rim spouting port 26 is formed. This first rim water conduit 22 leads flush water in the storage tank 4 to the first rim spouting port 26 via the common rim water conduit 20. This first rim spouting port 26 is arranged, as shown in FIG. 2, at a center on a left side of the bowl portion 8 when the toilet main body 2 is viewed from its front; that is, at a side of the concave portion 16. Flush water is spouted from the first rim spouting port 26 toward the front side of the bowl portion 8, to the shelf portion 14.

On the downstream end of the second rim water conduit 24, a second rim spouting port 28 is formed. This second rim water conduit 24 leads flush water in the storage tank 4 to the second rim spouting port 28 via the common rim water conduit 20. This second rim spouting port 28 is, as shown in FIG. 2, provided in a rear side which is determined when the bowl portion 8 is divided into two parts in a front-rear direction; and further, is arranged on a right side of the bowl portion 8 when the toilet main body 2 is viewed from its front. In addition, flush water is spouted also from the second rim spouting port 28 toward the rear side of the bowl portion 8, onto the shelf portion 14.

Here, the flush toilet 1 according to the embodiment is configured to spout flush water from the first rim spouting port 26 and second rim spouting port 28 to the bowl portion 8; and is not provided with a jet water spouting port and does not perform jet spouting.

As shown in FIG. 2, the discharge trap conduit 18 includes an inlet 30; and this inlet 30 communicates with the bowl portion 8 and concave portion 16. The discharge trap conduit 18 includes: an ascending conduit 32 that ascends rearward from the inlet 30; and a descending conduit 34 that descends frontward from a downstream end of this ascending conduit 32 (a top portion 32*a* of the ascending conduit 32) to a discharge opening 36. The top position (top portion 32*a*) of this discharge trap conduit 18 determines the position of a water sealing surface (water storage surface) W.

Further, the discharge trap conduit 18 has a right sidewall 18*a* and a left sidewall 18*b* when viewed from its front, each of which extends in a perpendicular direction (vertical direction); and a width W1 is constant in the up-down direction (see FIG. 3 to FIG. 6 and FIG. 8).

Next, the discharge trap conduit 18 will be described in detail with reference to FIG. 2 to FIG. 8. First, as shown in FIG. 2 and FIG. 7, the descending conduit 34 of the discharge trap conduit 18 includes a top surface 40 located on the front side; a rear surface 42 located on the rear side and extending substantially in the perpendicular direction; and a bottom surface 44 extending from the lower end of the rear surface 42 to the discharge opening 36 present in the front. The descending conduit 34 includes the right sidewall 18*a* and the left sidewall 18*b* described above. The right sidewall 18*a* forms the right side surface of the descending conduit 34 and the left sidewall 18*b* forms the left side surface of the descending conduit 34. The right side surface and the left side surface extend in the perpendicular direction (vertical direction); and a width W1 is constant in the up-down direction.

In the top surface 40 of the descending conduit 34, first, an arcuate portion 45 having a curvature radius R1 is formed on the upper side (upstream side) integrally with the bottom surface of the top portion 32*a* of the ascending conduit 32. The curvature radius R1 is preferably 10 mm to 50 mm. The arcuate portion 45 forms a gentle arcuate shape. Furthermore, a ceiling sloping surface 46 is formed on the lower side (downstream side) of the arcuate portion 45 of the top surface 40 of the descending conduit 34. The ceiling sloping surface 46 is inclined downward and forward from the upper end to the lower end thereof on the front side of the descending conduit 34. As shown in FIG. 7, the ceiling sloping surface 46 of the descending conduit 34 includes an upstream ceiling sloping surface 46*a* inclined downward by an angle θ1; and a downstream ceiling sloping surface 46*b* inclined downward by an angle θ2 (<θ1) smaller than the inclination angle of the upstream ceiling sloping surface 46*a*.

Figure 3:
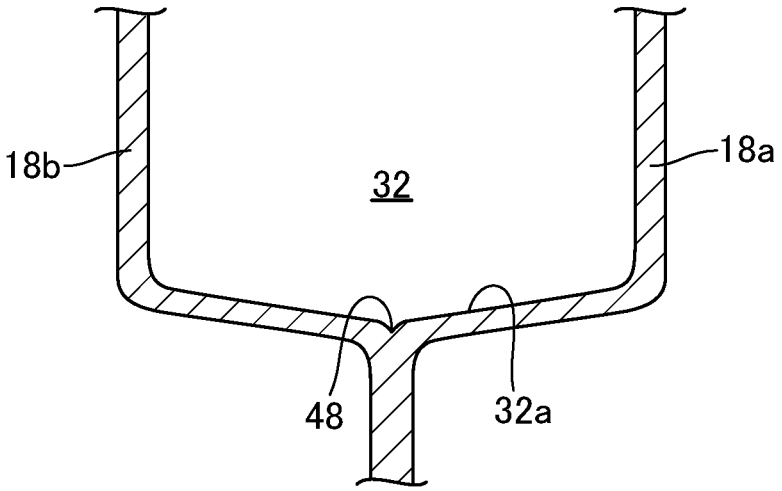
FIG. 3 is a sectional view of the flush toilet when viewed along the III-III line in FIG. 2.
Figure 4:
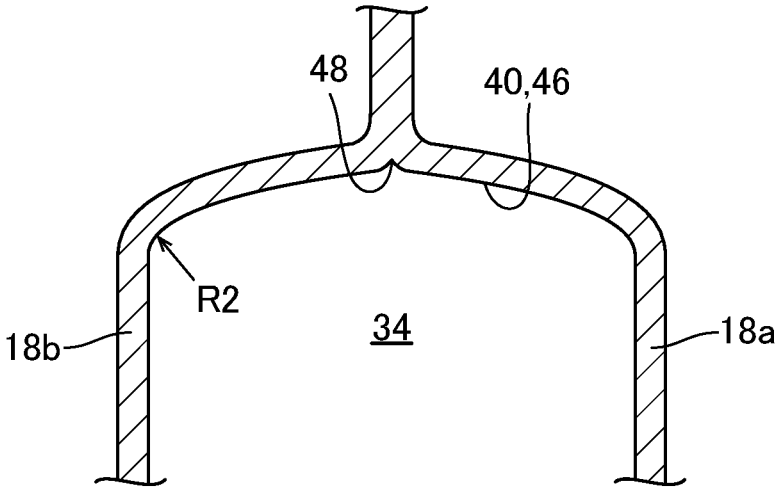
FIG. 4 is a sectional view of the flush toilet when viewed along the IV-IV line in FIG. 2.

Next, as shown in FIG. 3, a concave portion 48 is formed in the width direction center of the bottom surface of the top portion 32*a* of the ascending conduit 32. As shown in FIG. 4, similarly, the concave portion 48 is formed in the width direction center of the ceiling sloping surface 46 of the descending conduit 34. In this way, the concave portion 48 is continuously formed from the top portion 32*a* of the ascending conduit 32 to the upstream side of the ceiling sloping surface 46 of the descending conduit 34.

Figure 5:
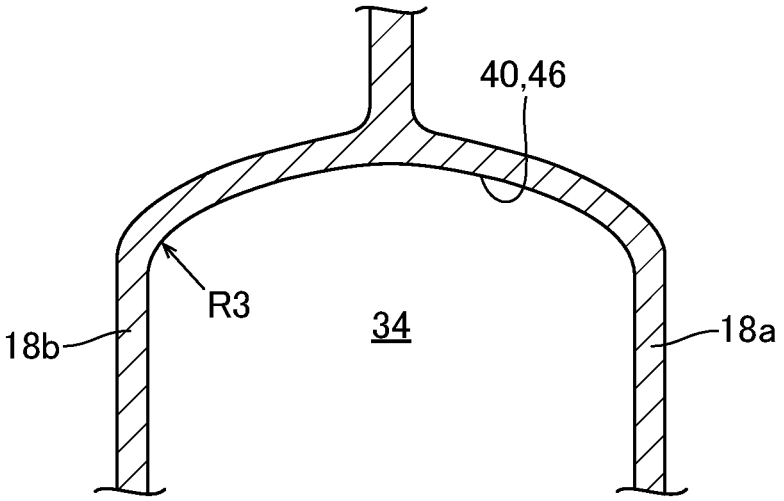
FIG. 5 is a sectional view of the flush toilet when viewed along the V-V line in FIG. 2.
Figure 6:
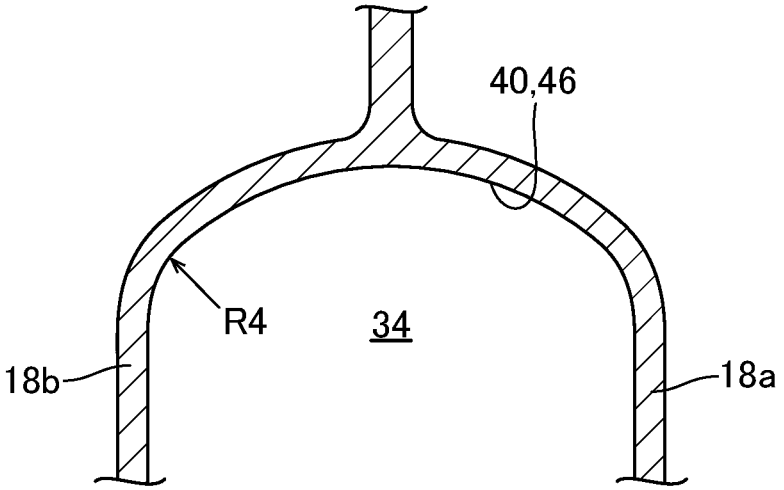
FIG. 6 is a sectional view of the flush toilet when viewed along the VI-VI line in FIG. 2.
Figure 7:
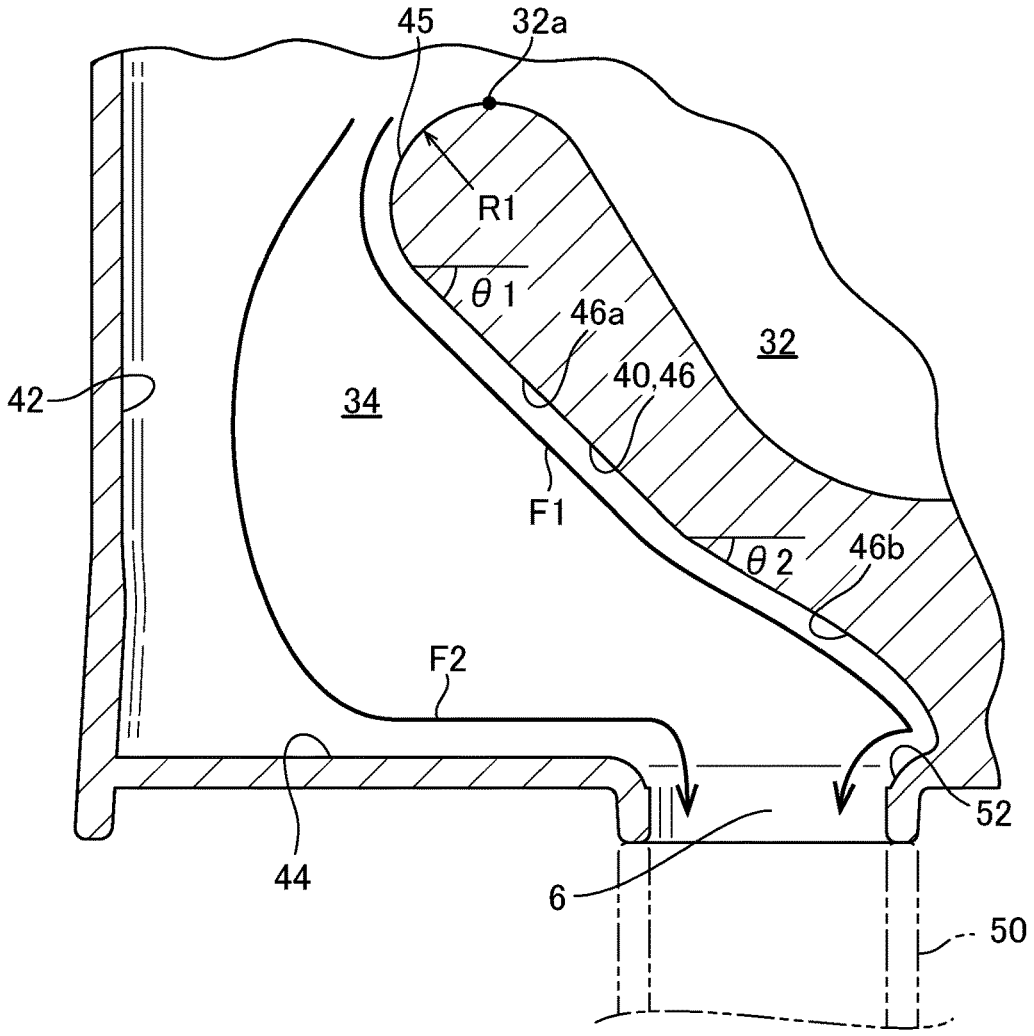
FIG. 7 is a partially enlarged longitudinal sectional view enlarging and showing a discharge flow passage shown in FIG. 2.

Next, as shown in FIG. 4 to FIG. 6, a surface connecting the ceiling sloping surface 46 and the left and right sidewalls 18*a* and 18*b* of the descending conduit 34 is formed in an arcuate shape. A curvature radius of the surface is set to decrease on the downstream side compared with the upstream side. Specifically, the surface connecting the ceiling sloping surface 46 and the left and right sidewalls 18*a* and 18*b* shown in FIG. 4 is formed at a curvature radius R2. The surface connecting the ceiling sloping surface 46 and the left and right sidewalls 18*a* and 18*b* shown in FIG. 5 is formed at a curvature radius R3. The surface connecting the ceiling sloping surface 46 and the left and right sidewalls 18*a* and 18*b* shown in FIG. 6 is formed at a curvature radius R4. The surface connecting the ceiling sloping surface 46 and the left and right sidewalls 18*a* and 18*b* is formed to satisfy a relation R2≤R3≤R4. R2, R3, and R4 are respectively preferably in a range of 10 mm to 45 mm based on the premise that this magnitude relation is satisfied.

Figure 8:
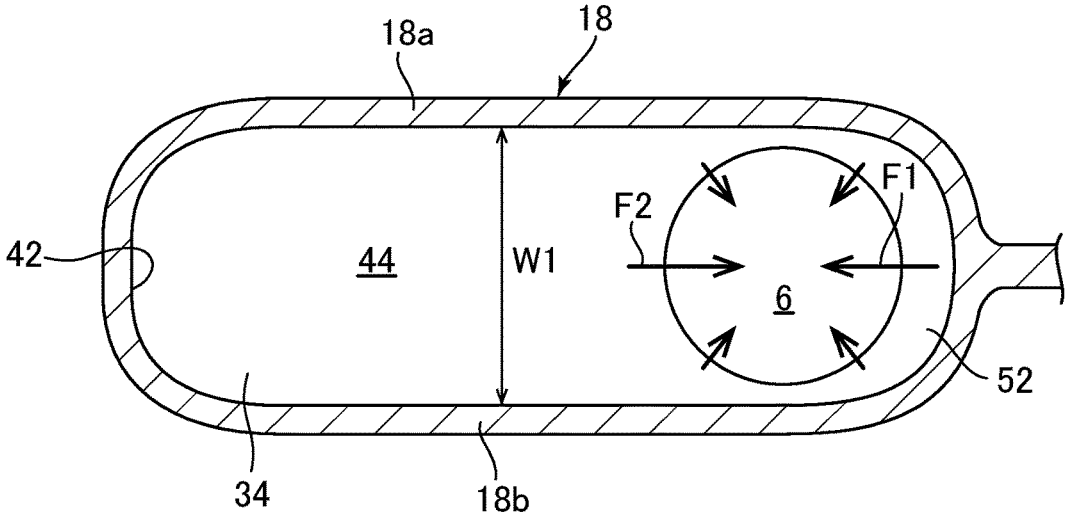
FIG. 8 is a plan view of the discharge flow passage shown in FIG. 7.

Next, as shown in FIG. 7 and FIG. 8, the bottom surface 44 of the descending conduit 34 is formed by a substantially flat surface. The discharge opening 36 is formed on the downstream side (front side) of the bottom surface 44. An inlet of a water discharge conduit 50 disposed on the outside is connected to the discharge opening 36.

A front bottom surface 52 is formed between the front end of the discharge opening 36 of the descending conduit 34 and the lower end of the ceiling sloping surface 46. As shown in FIG. 7, the front bottom surface 52 is formed to incline rearward and downward.

Next, the operation and working effects of the above flush toilet 1 of the embodiment will be described. When a user operates a switch, a discharge valve is brought into an open state, and flush water within the storage tank 4 is supplied from the tank discharge opening 6 into the common rim water conduit 20 of the toilet main body 2. The flush water which has flowed into the common rim water conduit 20 flows toward the front side; and branches and flows into the first rim water conduit 22 and the second rim water conduit 24. The flush water is led to the first rim spouting port 26 by the first rim water conduit 22 and is spouted from the first rim spouting port 26 onto the shelf portion 14. In addition, the flush water is led to the second rim spouting port 28 by the second rim water conduit 24 and is spouted from the second rim spouting port 28 onto the shelf portion 14.

The flush water is spouted to the front side from the first rim spouting port 26 and is also spouted to the rear side from the second rim spouting port 28. This flush water generates a swirling flow of swirling in an identical direction (counterclockwise). With the flush water that is spouted from the first rim spouting port 26, a front side area of the waste receiving surface 10 is mainly washed; and with the flush water that is spouted from the second rim spouting port 28, a rear side area of the waste receiving surface 10 of the bowl portion 8 is mainly washed.

Next, a flow of wastewater in the discharge trap conduit 18 of the flush toilet 1 according to this embodiment will be described with reference to FIG. 7 and FIG. 8. In the flush toilet 1 according to this embodiment, a part of wastewater flowing on the bottom surface of the top portion 32*a* of the ascending conduit 32 of the discharge trap conduit 18 flows along the arcuate portion 45 and the ceiling sloping surface 46 of the descending conduit 34 according to the Coanda effect and flows into the discharge opening 36 from the front side of the discharge opening 36 rearward (shown as a flow F1 in FIG. 7 and FIG. 8). On the other hand, the remainder of the wastewater flows along the bottom surface 44 of the descending conduit 34 and flows into the discharge opening 36 from the rear side toward the front side (shown as a flow F2 in FIG. 7 and FIG. 8). As a result, the flush toilet 1 according to this embodiment can disperse a flowing direction of the wastewater flowing into the discharge opening 36 to at least directions from the front side and from the rear side. Accordingly, self-siphonage can be suppressed from occurring within the discharge trap conduit 18 and the water discharge conduit 50. Thus, the flush toilet 1 according to this embodiment can suppress the sealing water in the flush toilet 1 from being drawn in toward the downstream side.

Next, as shown in FIG. 5 and FIG. 6, in the flush toilet 1 according to this embodiment, the concave portion 48 is formed from the bottom surface of the top portion 32*a* of the ascending conduit 32 of the discharge trap conduit 18 to the upstream side of the arcuate portion 45 and the ceiling sloping surface 46 of the descending conduit 34. Accordingly, compared with the case of a flat surface, the area of a contact surface in contact with wastewater in the arcuate portion 45 and the ceiling sloping surface 46 of the descending conduit 34 is large. As a result, the Coanda effect easily occurs on the bottom surface of the top portion 32*a* of the ascending conduit 32 to the arcuate portion 45 and the ceiling sloping surface 46 of the descending conduit 34. Consequently, in the descending conduit 34 of the discharge trap conduit 18, the flowing direction of the wastewater flowing into the discharge opening 36 can be further dispersed.

Furthermore, in the flush toilet 1 according to this embodiment, the left and right sidewalls 18*a* and 18*b* of the discharge trap conduit 18 are respectively formed to extend substantially perpendicularly in the up-down direction from the left and right side portions of the bottom surface of the top portion 32*a* of the ascending conduit 32 to the left and right side portions of the bottom surface 44 of the descending conduit 34. Accordingly, a flow along the left and right sidewalls 18*a* and 18*b* of the discharge trap conduit 18 is easily formed by the Coanda effect. Consequently, a flowing distance of the wastewater flowing on the left and right sidewalls 18*a* and 18*b* and a flowing distance of the wastewater flowing on the ceiling sloping surface 46 are different and timings of the wastewater flowing into the discharge opening 36 are different. Thus, the wastewater flowing into the discharge opening 36 can be temporally dispersed.

Next, as shown in FIG. 4 to FIG. 6, in the flush toilet 1 according to this embodiment, curvature radiuses R3 and R4 of a surface connecting the downstream ceiling sloping surface 46*b* and the left and right sidewalls 18*a* and 18*b* are larger than a curvature radius R2 of a surface connecting the upstream ceiling sloping surface 46*a* and the left and right sidewalls 18*a* and 18*b*. Accordingly, the Coanda effect weakens on the downstream ceiling sloping surface 46*b* and a part of the wastewater flowing along the downstream ceiling sloping surface 46*b* flows down along the left and right sidewalls 18*a* and 18*b*. Thus, the flush toilet 1 according to this embodiment can further disperse the flowing direction of the wastewater flowing into the discharge opening 36.

Next, as shown in FIG. 7 and FIG. 8, in the flush toilet 1 according to this embodiment, the waste water flowing to the lower end along the ceiling sloping surface 46 of the descending conduit 34 of the discharge trap conduit 18 flows to the discharge opening 36 from the front bottom surface 52 in the front of the discharge opening 36 rearward. Accordingly, occurrence of a flow of a large amount of the wastewater along the front end of the water discharge conduit 50, which occurs when the wastewater flows into the discharge opening 36 from the bottom surface 44 forward, can be suppressed. Consequently, the flush toilet 1 according to this embodiment can suppress self-siphonage from occurring within the water discharge conduit 50.

Next, a basic structure of a flush toilet according to a second embodiment of the present invention will be described with reference to FIG. 9 and FIG. 10.

A flush toilet 101 according to the second embodiment has the same basic structure as the basic structure of the flush toilet 1 according to the first embodiment described above. Therefore, the same portions as the portions of the flush toilet according to the first embodiment are denoted by the same reference numerals and signs and explanation of the portions is omitted. Different portions are mainly described below.

Figure 9:
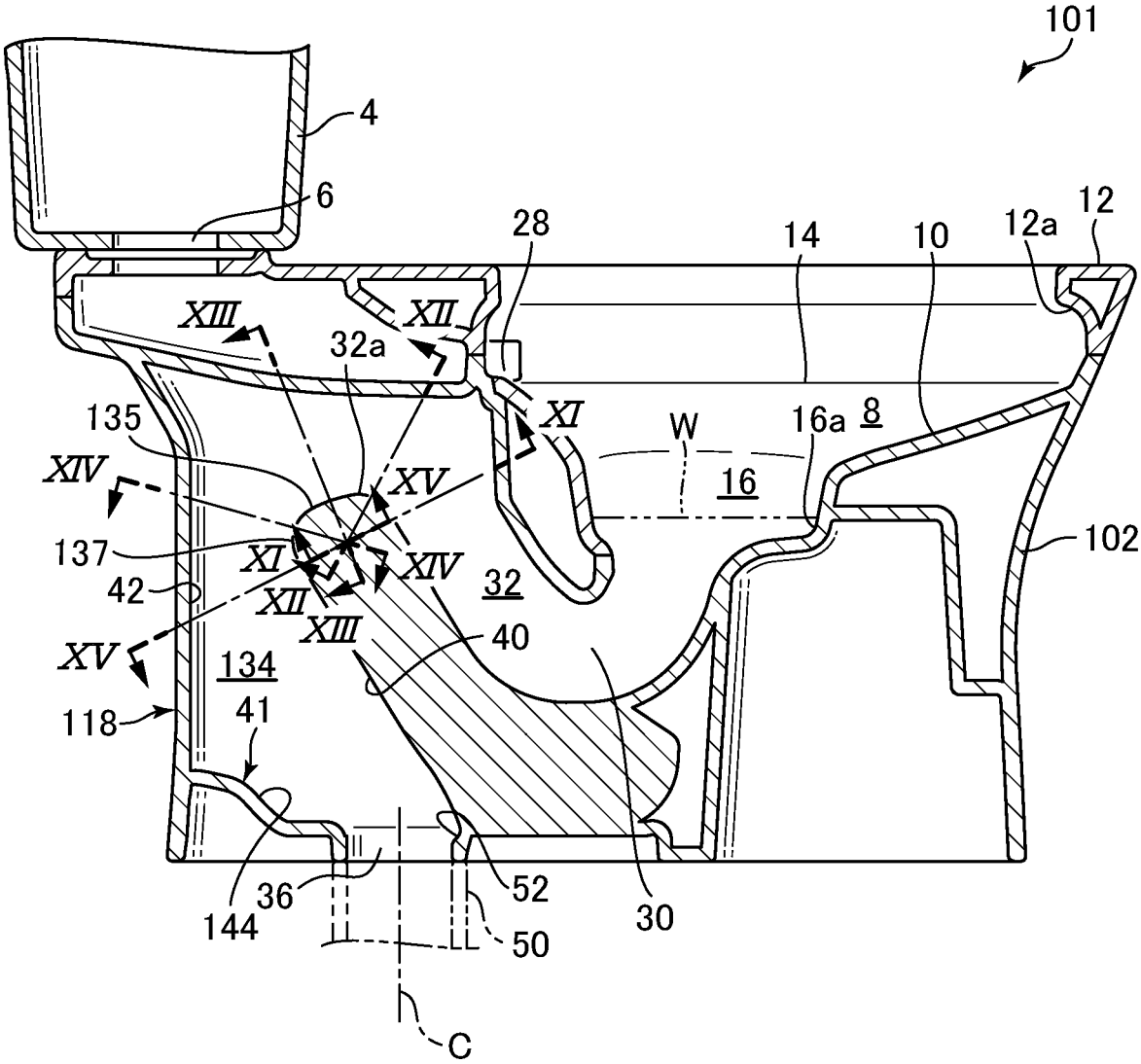
FIG. 9 is a longitudinal sectional view of a flush toilet according to a second embodiment of the present invention.

As shown in FIG. 9, the flush toilet 101 according to the second embodiment of the present invention includes a toilet main body 102 and a water storage tank 4 that stores flush water supplied to the toilet main body 102.

A discharge trap conduit 118, which is a discharge flow passage for discharging waster together with the flush water, is formed on the lower side of the concave portion 16 of the bowl portion 8 of the toilet main body 102.

The discharge trap conduit 118 includes an ascending conduit 32 that ascends from an inlet 30 rearward; and a descending conduit 134 that descends from a downstream end of the ascending conduit 32 (a top portion 32*a* of the ascending conduit 32) to the discharge opening 36 forward.

Figure 17:
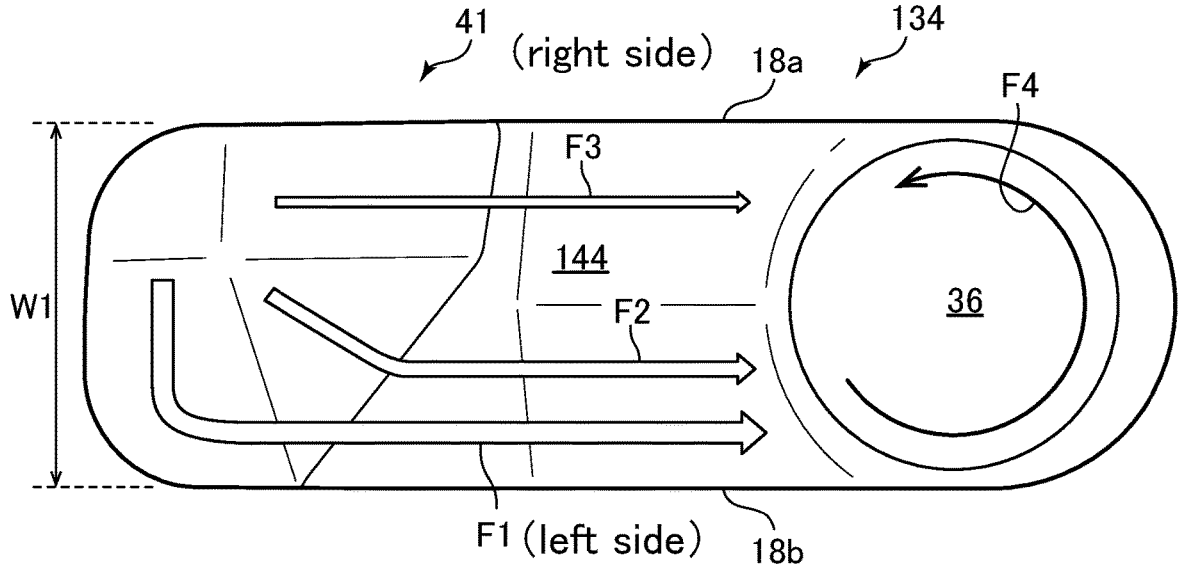
FIG. 17 is a plan view showing the bottom surface of the descending conduit shown in FIG. 16.

Furthermore, the discharge trap conduit 118 has a right sidewall 18*a* and a left sidewall 18*b* when viewed from its front, each of which extends in a perpendicular direction (vertical direction); and a width W1 in the left-right direction is constant in the up-down direction (see FIG. 17).

Next, the discharge trap conduit 118 will be described in detail with reference to FIG. 9 to FIG. 15.

Figure 10:
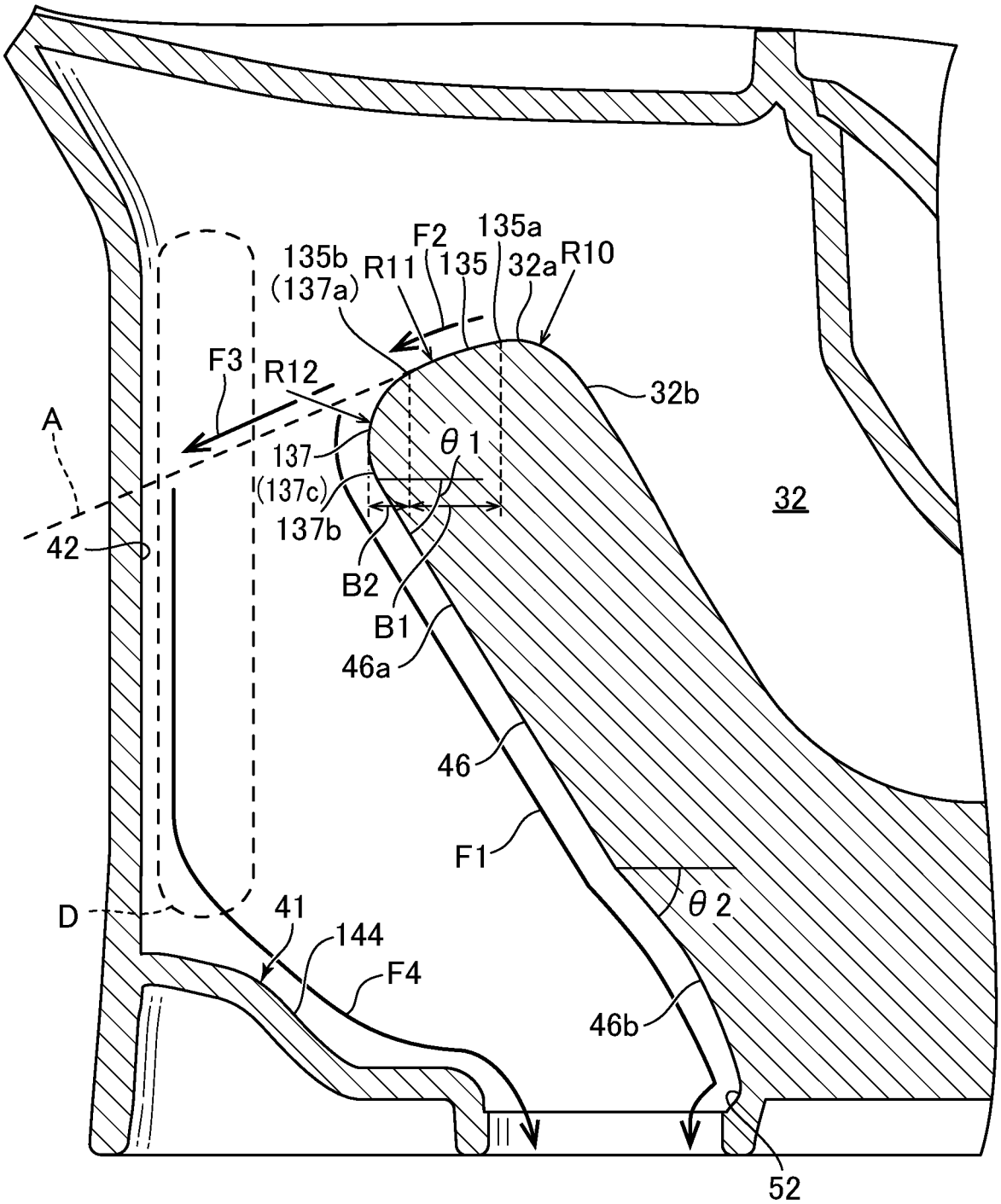
FIG. 10 is a partially enlarged longitudinal sectional view enlarging and showing a discharge flow passage shown in FIG. 9.
Figure 11:
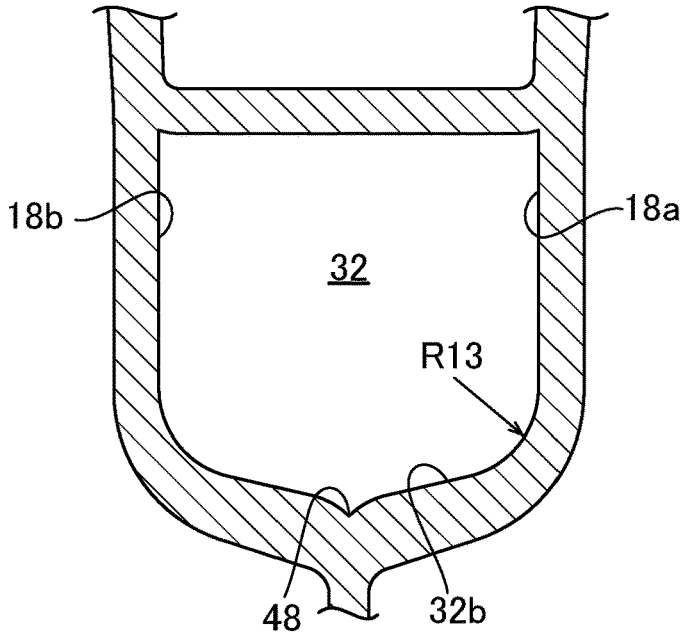
FIG. 11 is a sectional view of the flush toilet when viewed along the XI-XI line in FIG. 9.

As shown in FIG. 9 and FIG. 10, the descending conduit 134 of the discharge trap conduit 118 includes the top surface 40 located on the front side; the rear surface 42 located on the rear side and extending substantially in the perpendicular direction; and a bottom surface 144 extending from the lower end of the rear surface 42 to the discharge opening 36 present in the front. The right sidewall 18*a* forms the right side surface of the descending conduit 134 and the left sidewall 18*b* forms the left side surface of the descending conduit 134.

As shown in FIG. 10, the descending conduit 134 further includes: a descending bottom surface 135 inclined downward and rearward from the top portion 32*a* of the ascending conduit 32; and a connecting surface 137 that connects the lower end of the descending bottom surface 135 and the upper end of the ceiling sloping surface 46 described below of the descending conduit 134.

The descending bottom surface 135 is formed integrally with the bottom surface of the top portion 32*a* of the ascending conduit 32. The descending bottom surface 135 forms a part of the top surface of the descending conduit 134. The descending bottom surface 135 forms a curved surface having an arcuate shape extending toward an upper region D of the bottom surface 144. Note that the descending bottom surface 135 may be formed to extend toward the bottom surface 144. The descending bottom surface 135 forms an arcuate shape having a relatively large curvature radius R11 from a front end 135*a* to a rear end 135*b* in a cross section in the front-rear direction of the toilet main body 2. Note that the descending bottom surface 135 may form a straight line from the front end 135*a* to the rear end 135*b* in the sectional view. When the descending bottom surface 135 forms the straight line from the front end 135*a* to the rear end 135*b*, a curvature radius of the straight line of the descending bottom surface 135 is substantially infinite (an extremely large curvature radius).

A connecting portion of the descending bottom surface 135 and the connecting surface 137 is the rear end 135*b* of the descending bottom surface 135 (an upper end (front end) 137*a* of the connecting surface 137). The curvature radius changes in the front and the rear of the connecting portion. The curvature radius R11 of the descending bottom surface 135 is, for example, 30 mm to 50 mm in a longitudinal sectional view shown in FIG. 10. Note that a curvature radius R10 of the bottom surface leading to the top portion 32*a* of the ascending conduit 32 connected to the descending bottom surface 135 is, for example, 10 mm to 40 mm in the longitudinal sectional view shown in FIG. 10.

The descending bottom surface 135 in this embodiment extends toward the upper region D of the bottom surface 144, in other words, the rear surface 42. Accordingly, an imaginary tangential line A of the descending bottom surface 135 crosses the upper region D (or the rear surface 42) of the bottom surface 144. The descending bottom surface 135 can, with a surface having a relatively large curvature radius, align a flow of flush water flowing on the descending bottom surface 135 in a direction along the descending bottom surface 135 and make it easy to lead the flow of the flush water to this direction.

Figure 13:
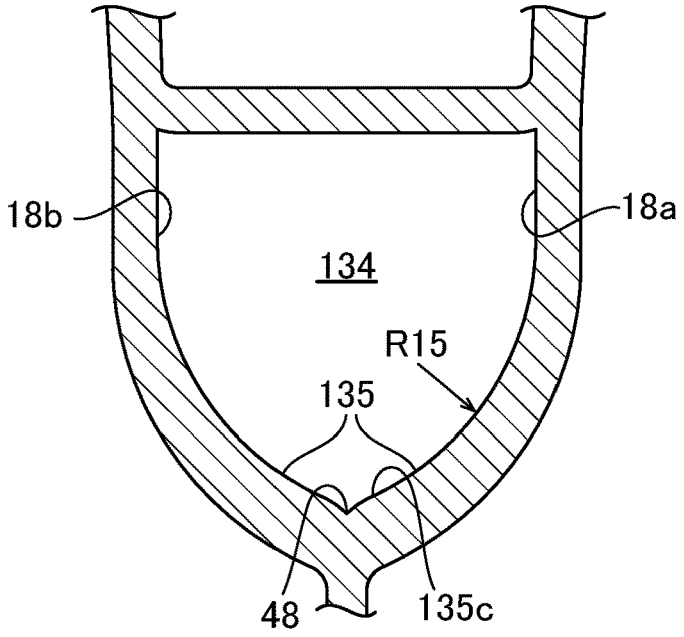
FIG. 13 is a sectional view of the flush toilet when viewed along the XIII-XIII line in FIG. 9.

As shown in FIG. 13, the descending bottom surface 135 forms a flat portion 135*c*, which is relatively flat, spreading in the left-right direction in a center-side region of a cross section in the left-right direction of the toilet main body 2.

As shown in FIG. 10, the connecting surface 137 is formed integrally with the descending bottom surface 135. The connecting surface 137 forms a part of the top surface of the descending conduit 134. The connecting surface 137 has a curvature radius R12 in a vertical cross section in the front-rear direction. The connecting surface 137 is formed such that the curvature radius R12 of the connecting surface 137 is smaller than the curvature radius R11 of the descending bottom surface 135. In this way, the connecting surface 137 forms an arcuate shape having a relatively small curvature radius R12 from the upper end (front end) 137*a* to a lower end 137*b* in a cross section in the front-rear direction of the toilet main body 2. In this embodiment, the connecting surface 137 forms a curved surface folded back from the rear direction to the front direction. Accordingly, a rear end 137*c* of the connecting surface 137 is formed between the upper end (front end) 137*a* and the lower end 137*b*. The rear end 137*c* of the connecting surface 137 of the descending conduit 134 is located further in the rear than the center axis C (see FIG. 9) of the discharge opening 36. The curvature radius R12 is, for example, 10 mm to 25 mm in the longitudinal sectional view shown in FIG. 9.

In the beginning, the flush water flowing into such a connecting surface 137 forms a flow in a direction along the descending bottom surface 135. On the other hand, the connecting surface 137 forms a curved surface having a relatively small curvature radius. Accordingly, the flush water less easily forms a flow along the connecting surface 137. Thus, the flush water is easily peeled from the connecting surface 137.

Length B2 in the front-rear direction from the upper end (front end) 137*a* to the rear end 137*c* of the connecting surface 137 of the descending conduit 134 is smaller than length B1 in the front-rear direction from the front end 135*a* to the rear end 135*b* of the descending bottom surface 135. Accordingly, the flush water less easily flows along the connecting surface 137. The flush water flowing along the connecting surface 137 from the descending bottom surface 135 can be easily peeled toward the upper region on the bottom surface 144 side.

Figure 14:
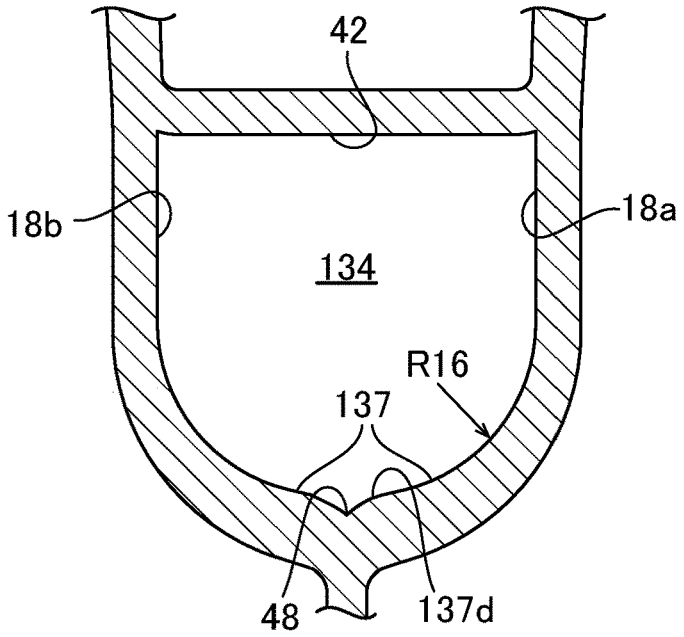
FIG. 14 is a sectional view of the flush toilet when viewed along the XIV-XIV line in FIG. 9.

As shown in FIG. 14, the connecting surface 137 forms a flat portion 137*d*, which is relatively flat, spreading in the left-right direction in the center-side region of the cross section in the left-right direction of the toilet main body 2.

As shown in FIG. 10, the descending conduit 134 further includes the ceiling sloping surface 46 formed on the lower side (downstream side) of the connecting surface 137. The ceiling sloping surface 46 is formed integrally with the connecting surface 137. The ceiling sloping surface 46 forms a part of the top surface of the descending conduit 134. The ceiling sloping surface 46 is inclined downward and forward from the upper end to the lower end of the descending conduit 134 on the front side of the descending conduit 134. The ceiling sloping surface 46 of the descending conduit 134 includes an upstream ceiling sloping surface 46*a* inclined downward by the angle θ1; and a downstream ceiling sloping surface 46*b* inclined downward by the angle θ2 (<θ1) smaller than the inclination angle of the upstream ceiling sloping surface 46*a*.

Figure 12:
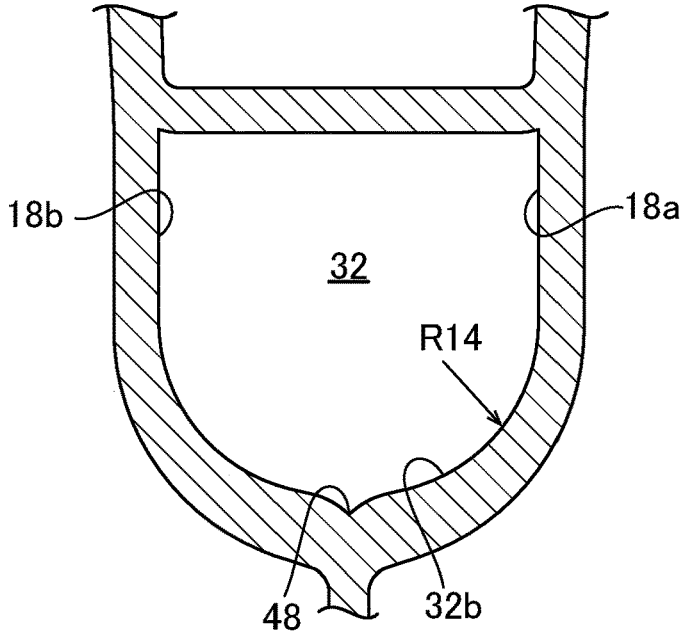
FIG. 12 is a sectional view of the flush toilet when viewed along the XII-XII line in FIG. 9.
Figure 15:
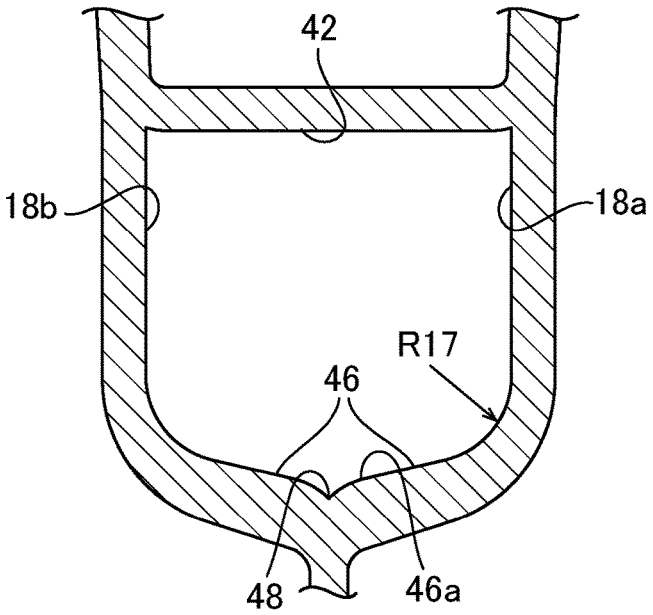
FIG. 15 is a sectional view of the flush toilet when viewed along the XV-XV line in FIG. 9.

Next, as shown in FIG. 12, the concave portion 48 is formed in the width-direction center of the bottom surface of the top portion 32*a* of the ascending conduit 32. As shown in FIG. 13 to FIG. 15, similarly, the concave portion 48 is formed in the width-direction centers of the descending bottom surface 135, the connecting surface 137, and the ceiling sloping surface 46 of the descending conduit 134. In this way, the concave portion 48 is continuously formed from the top portion 32*a* of the ascending conduit 32 to the upstream ceiling sloping surface 46*a* of the ceiling sloping surface 46 of the descending conduit 134.

Next, as shown in FIG. 11 to FIG. 15, a surface connecting the ascending conduit 32 or the descending conduit 134 and the left and right sidewalls 18*a* and 18*b* is mainly formed in an arcuate shape. A curvature radius R15 of a surface connecting the descending bottom surface 135 of the descending conduit 134 and the left and right sidewalls 18*a* and 18*b* is larger than a curvature radius R13 (or R14) of a surface connecting a bottom surface 32*b* of an ascending portion of the ascending conduit 32 and the left and right sidewalls 18*a* and 18*b*. The curvature radius R14 is larger than the curvature radius R13. Furthermore, a surface connecting the connecting surface 137 and the left and right sidewalls 18*a* and 18*b* is formed at a curvature radius R16 and a surface connecting the upstream ceiling sloping surface 46*a* and the left and right sidewalls 18*a* and 18*b* is formed at a curvature radius R17. Accordingly, the surface connecting the ascending conduit 32 or the descending conduit 134 and the left and right sidewalls 18*a* and 18*b* is formed to satisfy a relation R13<R14<R15. The surface connecting the descending conduit 134 and the left and right sidewalls 18*a* and 18*b* is formed to satisfy a relation R17<R16<R15.

Furthermore, on the ceiling sloping surface 46 of the descending conduit 134, a curvature radius of a surface connecting the ceiling sloping surface 46 and the left and right sidewalls 18*a* and 18*b* is set to be smaller on the downstream side compared with the upstream side. Specifically, the surface connecting the ceiling sloping surface 46 and the left and right sidewalls 18*a* and 18*b* is formed at the curvature radius R2 (see FIG. 4), the surface connecting the ceiling sloping surface 46 and the left and right sidewalls 18*a* and 18*b* is formed at the curvature radius R3 (see FIG. 5), and the surface connecting the ceiling sloping surface 46 and the left and right sidewalls 18*a* and 18*b* is formed at the curvature radius R4 (see FIG. 6). The surface connecting the ceiling sloping surface 46 and the left and right sidewalls 18*a* and 18*b* is formed to satisfy a relation R2≤R3≤R4. R2, R3, and R4 are respectively preferably in a range of 10 mm to 45 mm based on the premise that this magnitude relation is satisfied.

Figure 16:
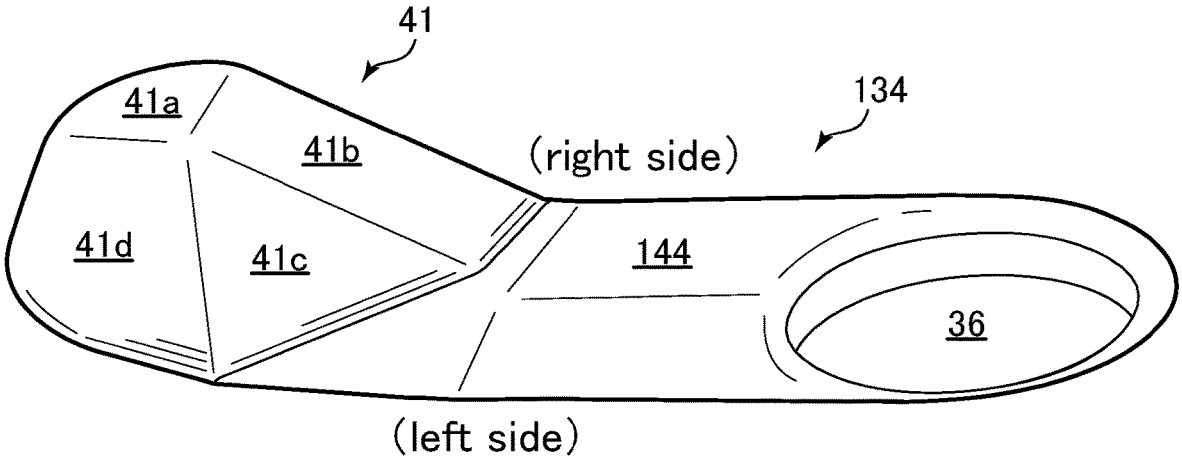
FIG. 16 is a perspective view showing the bottom surface of a descending conduit of the flush toilet according to the second embodiment of the present invention.

Next, a bottom surface of the descending conduit 134 of the discharge trap conduit 18 will be described in detail with reference to FIG. 9, FIG. 16, and FIG. 17. FIG. 16 is a perspective view showing a bottom surface of the descending flow passage of the flush toilet according to the second embodiment of the present invention; and FIG. 17 is a plan view showing the bottom surface of the descending flow passage in FIG. 16.

As shown in FIG. 16 and FIG. 17, the descending conduit 134 includes a bottom surface 144; this bottom surface 144 forms an area on the rear side (upstream side) of the discharge opening 36.

As shown in FIG. 16, in the rear side (upstream side) of the bottom surface 144 of the descending conduit 134, a guiding portion 41 is provided. This guiding portion 41 includes four surfaces of an upper surface 41*a*, a ceiling sloping surface 41*b*, a ceiling sloping surface 41*c*, and a ceiling sloping surface 41*d*. All of these four surfaces 41*a*, 41*b*, 41*c*, and 41*d* are flat.

The upper surface 41*a* is a flat surface formed at the top position on the right side on the most rear side (most upstream side) and is a little inclined toward the front side (downstream side). Alternatively, this upper surface 41*a* may be a horizontal surface without inclination. The ceiling sloping surface 41*b* is a rectangular ceiling sloping surface that is inclined downward from the front end of the upper surface 41*a* toward the front. The ceiling sloping surface 41*c* is a triangular ceiling sloping surface that is inclined obliquely downward from the left side end of the ceiling sloping surface 41*b* toward the left side and the front. The ceiling sloping surface 41*d* is a rectangular ceiling sloping surface that is inclined downward from the left side end of the upper surface 41*a* toward the left side. Here, the inclination angle of the upper surface 41*a* that is a flat surface is smaller than the inclination angle of any of the other ceiling sloping surfaces 41*b*, 41*c*, and 41*d*.

Note that, as a modification, an upper surface 41*a* may be formed on the left side, a sloping surface 41*c* may be formed to incline obliquely downward from the right side end to the right side and the front of a sloping surface 41*b*, and a sloping surface 41*d* may be formed to incline downward from the right side end toward the right side of the upper surface 41*a*. At this time, a swirling flow in the discharge opening 36 changes to a swirling flow in the opposite direction of F4 described below.

The bottom surface 144 of the descending conduit 134 according to the second embodiment of the present invention (the same applies to a modification of the bottom surface 144 of the descending conduit 134 described below) can be applied to the descending conduit 34 according to the first embodiment of the present invention instead of the bottom surface 44 of the descending conduit 34 according to the first embodiment of the present invention.

Figure 18:
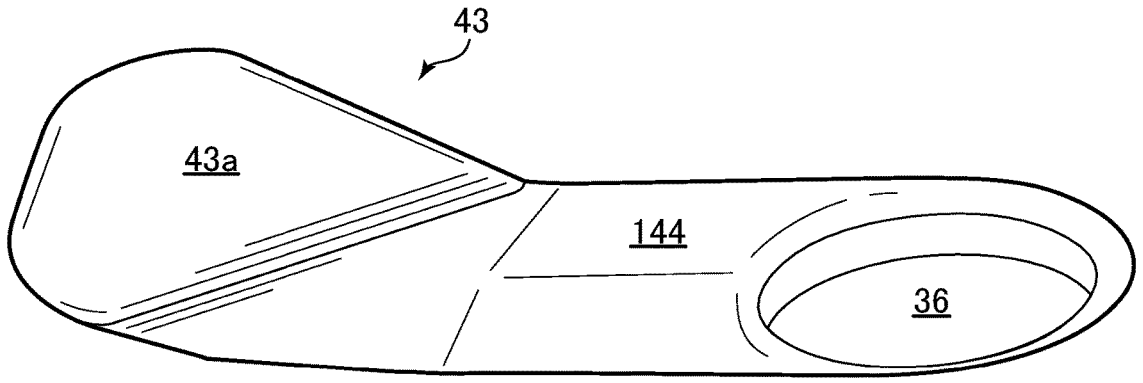
FIG. 18 is a perspective view showing a modification of the bottom surface of the descending conduit of the flush toilet according to the second embodiment of the present invention.

Next, a modified example of the above flush toilet of the embodiment will be described with reference to FIG. 18. FIG. 18 is a perspective view showing a modified example of the bottom surface of the descending conduit of the flush toilet according to the second embodiment of the present invention. In the modified example shown in FIG. 18, a guiding portion 43 is formed at the most rear side (the most upstream side) of the bottom surface 144 of the descending conduit 134. This guiding portion 43 includes a triangular flat ceiling sloping surface 43*a* that is inclined obliquely downward toward the right side and front side.

Also, in the flush toilet according to this modified example, the wastewater which has flowed down from the upstream side of the descending conduit 134 collides with the ceiling sloping surface 43*a* of the guiding portion 43, as with the above described flush toilet 1. The wastewater which has collided with the ceiling sloping surface 43*a* flows along this surface toward the left side. Therefore, the horizontal directional flow of wastewater on the bottom surface 144 of the descending conduit 134 is turned into a flow directed to the left side of the center of the discharge opening 36; that is, the flow is turned into a flow decentered to the left side. After this, the wastewater flows into the discharge opening 36 while deviating from the center of the discharge opening 36 and generates a swirling flow within the discharge opening 36 (see flow F4 in FIG. 17). Note that the entire or a part of the descending conduit 134 may be formed by a discharge socket made of resin (not shown in the figures).

Next, the operation and working effects of the above flush toilet 101 according to this embodiment will be described. When user operates a switch (not shown in the figures), a discharge valve is brought into an open state, and flush water in the water storage tank 4 is supplied to the bowl portion 8 and a waste receiving surface 10 of the bowl portion 8 is cleaned.

Next, a flow of wastewater in the discharge trap conduit 118 of the flush toilet 101 according to this embodiment will be described with reference to FIG. 10. In the flush toilet 101 according to this embodiment, wastewater flowing on the bottom surface of the top portion 32*a* of the ascending conduit 32 of the discharge trap conduit 118 forms a flow of flush water flowing on the descending bottom surface 135. The flow of the flush water flowing on the descending bottom surface 135 is aligned in a direction along the descending bottom surface 135 and is easily guided in this direction as indicated by an arrow F2.

Apart of the flush water flowing into the connecting surface 137 from the descending bottom surface 135 flows along the connecting surface 137 and the ceiling sloping surface 46 according to the Coanda effect and flows into the discharge opening 36 from the front side of the discharge opening 36 rearward (indicated as a flow F1 in FIG. 10).

On the other hand, the remaining portion of the flush water flowing into the connecting surface 137 is peeled from the connecting surface 137 as indicated by an arrow F3 because the connecting surface 137 forms a curved surface having a relatively small curvature radius. More specifically, the flush water flowing into the connecting surface 137 forms a flow in the direction of the descending bottom surface 135 (the direction of an imaginary tangential line A) as indicated by the arrow F2. On the other hand, the connecting surface 137 is formed to be curved to separate from the imaginary tangential line A. Accordingly, the flush water flowing into the connecting surface 137 is easily peeled from the connecting surface 137.

The length B2 in the front-rear direction from the upper end (front end) 137*a* to the rear end 137*c* of the connecting surface 137 is smaller than the length B1 in the front-rear direction from the front end 135*a* to the rear end 135*b* of the descending bottom surface 135. Accordingly, the flush water less easily flows along the connecting surface 137. The flush water flowing along the connecting surface 137 from the descending bottom surface 135 can be more easily peeled toward a region on the bottom surface 144 side.

Furthermore, the curvature radius R15 of the connecting surface connecting the descending bottom surface 135 of the descending conduit 134 and the left and right sidewalls 18*a* and 18*b* is larger than the curvature radius R13 of the connecting surface connecting the bottom surface 32*b* of the ascending portion of the ascending conduit 32 and the left and right sidewalls 18*a* and 18*b*. Consequently, the height from the descending bottom surface 135 of the water surface of the flush water flowing between the descending bottom surface 135 of the descending conduit 134 and the left and right sidewalls 18*a* and 18*b* is larger than the height from the bottom surface 32*b* of the ascending portion of the water surface of the flush water flowing between the bottom surface 32*b* of the ascending portion of the ascending conduit 32 and the left and right sidewalls 18*a* and 18*b*. The flow rate of the flush water flowing on the descending bottom surface 135 is higher than the flow rate of the flush water flowing on the bottom surface of the ascending portion of the ascending conduit 32. Thus, according to the present invention, the flow of the flush water directed to the region on the bottom surface 144 side by the descending bottom surface 135 can be more easily peeled from the connecting surface 137.

The flush water peeled from the connecting surface 137 flows to jump out to the rear of the toilet main body 2 along the imaginary tangential line A because the flush water forms the flow in the direction of the descending bottom surface 135 as indicated by the arrow F3. As indicated by an arrow F4, the flush water mainly flows downward from the rear surface 42 (the rear of the bottom surface 144) side and flows along the bottom surface 144 of the descending conduit 134.

The rear end 137*c* of the connecting surface 137 of the descending conduit 134 is located further in the rear than the center axis C of the discharge opening 36. The flush water peeled from the connecting surface 137 of the descending conduit 134 easily lands on the bottom surface 144 on the rear side of the discharge opening 36. Consequently, a flowing direction of the flush water flowing into the discharge opening 36 can be more surely dispersed to at least directions from the front side and from the bottom surface 144 on the rear side.

As shown in FIG. 17, as indicated by the arrow F4, wastewater which has flowed down from the upstream side of the descending conduit 134 collides with the four surfaces 41*a*, 41*b*, 41*c*, and 41*d* of the guiding portion 41 (see FIG. 16). The wastewater which has collided with the upper surface 41*a* generates a disturbed flow and thereafter flows along the ceiling sloping surface 41*b*, the ceiling sloping surface 41*c*, and the ceiling sloping surface 41*d*.

The wastewater which has collided with the ceiling sloping surface 41*b* and the wastewater which has flowed down from the upper surface 41*a* flow on along the surface of the ceiling sloping surface 41*b* to the front side (see the flow F3 in FIG. 17). The wastewater which has collided with the ceiling sloping surface 41*c* and the ceiling sloping surface 41*d* and the wastewater which has flowed down from the upper surface 41*a* flow along these surfaces toward the left side (see the flows F1 and F2 in FIG. 17). The flow rate of the wastewater of the flows F1 and F2 flowing toward the left side is higher than the flow rate of the wastewater of the flow F3 flowing toward the front side. Therefore, the horizontal directional flow of the wastewater on the bottom surface 144 of the descending conduit 134 is turned into a flow directed further to the left side than the center of the discharge opening 36; that is, the flow toward the center of the discharge opening 36 is deviated toward the side of the left sidewall 18*b*, turning into a decentered flow. After this, the wastewater flows into the discharge opening 36 while deviating from the center of the discharge opening 36 and generates a swirling flow in the discharge opening 36 (see the flow F4 in FIG. 17).

In this way, the flush water peeled from the connecting surface 137 flows along the bottom surface 144 of the descending conduit 134 and flows into the discharge opening 36 from the rear side toward the front side (indicated as flow F4 in FIG. 10).

The flush toilet 101 according to this embodiment can disperse the flowing direction of the wastewater flowing into the discharge opening 36 to at least directions from the front side and from the rear side. Accordingly, self-siphonage can be suppressed from occurring within the discharge trap conduit 118 and the water discharge conduit 50. Thus, the flush toilet 101 according to this embodiment can suppress the sealing water in the flush toilet 101 from being drawn in toward the downstream side.

With the flush toilet 101 according to this embodiment, the flow of the flush water can be formed toward one of the bottom surface 144 of the descending conduit 134 and the upper region D of the bottom surface 144 by the descending bottom surface 135 of the descending conduit 134. Furthermore, since a curvature radius of the connecting surface 137 of the descending conduit 134 is smaller than a curvature radius of the descending bottom surface 135, the flow of the flush water directed to the region on the bottom surface 144 side by the descending bottom surface 135 can be easily peeled from the connecting surface 137 by the connecting surface 137. As a result, according to the present invention, the flush water flowing along the connecting surface 137 from the descending bottom surface 135 can be easily peeled toward the upper region D or the like of the bottom surface 144. Self-siphonage can be suppressed from occurring within the discharge flow passage and the water discharge conduit because an amount of the flush water flowing along the ceiling sloping surface 46 from the connecting surface 137 is excessively large.

With the flush toilet 101 according to this embodiment, the length B2 in the front-rear direction from the front end 137*a* to the rear end 137*c* of the connecting surface 137 of the descending conduit 134 is smaller than the length B1 in the front-rear direction from the front end 135*a* to the rear end 135*b* of the descending bottom surface 135. Accordingly, the flush water less easily flows along the connecting surface 137. The flush water flowing along the connecting surface 137 from the descending bottom surface 135 can be easily peeled toward the upper region D of the bottom surface 144 or the like. Thus, self-siphonage can be further suppressed from occurring within the discharge flow passage and the water discharge conduit because an amount of the flush water flowing along the ceiling sloping surface 46 from the connecting surface 137 is excessively large.

With the flush toilet 101 according to this embodiment, the flush water peeled from the connecting surface 137 of the descending conduit 134 easily lands on the bottom surface 144 on the rear side of the discharge opening 36. Consequently, the flowing direction of the flush water flowing into the discharge opening 36 can be more surely dispersed to at least directions from the front side and from the bottom surface 144 on the rear side. Self-siphonage can be suppressed from occurring within the discharge flow passage and the water discharge conduit.

With the flush toilet 101 according to this embodiment, the curvature radius R15 of the connecting surface connecting the descending bottom surface 135 of the descending conduit 134 and the sidewalls is larger than the curvature radius R13 (or R14) of the connecting surface connecting the bottom surface 32*b* of the ascending portion of the ascending conduit 32 and the sidewalls. Consequently, the height from the descending bottom surface 135 of the water surface of the flush water flowing between the descending bottom surface 135 of the descending conduit 134 and the sidewalls is larger than the height from the bottom surface 32*b* of the ascending portion of the water surface of the flush water flowing between the bottom surface 32*b* of the ascending portion of the ascending conduit 32 and the sidewalls. The flow rate of the flush water flowing on the descending bottom surface 135 is higher than the flow rate of the flush water flowing on the bottom surface 32*b* of the ascending portion of the ascending conduit 32. Thus, according to the present invention, the flow of the flush water directed to the upper region D on the bottom surface 144 by the descending bottom surface 135 can be more easily peeled from the connecting surface 137.

With the flush toilet 101 according to this embodiment, the guiding portion 41 is formed on the bottom surface 144 of the descending conduit 134 of the discharge flow passage. The guiding portion guides the horizontally directed flow of wastewater, which flows toward the discharge opening 36, to be directed to either a left or right side of the center of the discharge opening 36. Accordingly, this guiding portion 41 makes the wastewater, which flows into the discharge opening 36, easily flow in while deviating from the center of the discharge opening 36. Accordingly, self-siphonage, otherwise occurring due to wastewater sealing the discharge flow passage (such as a discharge trap) and a part of the water discharge conduit, can be suppressed from occurring within the discharge flow passage and water discharge conduit. Thus, according to the present invention, the sealing water in the flush toilet 101 can be further suppressed from being drawn in toward the downstream side.

As a modification, the descending conduit 134 may be formed in a state in which one of the descending bottom surface 135 and the connecting surface 137 is changed to a flow passage having another shape, that is, one of the descending bottom surface 135 and the connecting surface 137 is adopted. In this case, a flow of the flush water in a degree corresponding to the shape of the descending bottom surface 135 or the connecting surface 137 can be generated.

What is claimed is:

1. A flush toilet that discharges waste by a water pressure caused by a head of flush water within a bowl, comprising:

a bowl portion for receiving waste; and a discharge flow passage connected to a lower portion of the bowl portion and extending to a discharge opening connected to an inlet of an external water discharge conduit, a part of the discharge flow passage storing sealing water;

wherein the discharge flow passage includes an ascending flow passage ascending rearward from the lower portion of the bowl portion and a descending flow passage descending from a downstream end of the ascending flow passage to the discharge opening, the descending flow passage of the discharge flow passage includes a bottom surface on a rear side from the discharge opening, and a ceiling sloping surface formed on a front side of the discharge flow passage, an upper end of the ceiling sloping surface being formed integrally with a bottom surface of the top portion of the ascending flow passage, and the ceiling sloping surface being inclined downward and forward from the upper end to a lower end thereof, and the discharge flow passage includes a V-shaped groove formed on a flat surface or an arcuate surface from the bottom surface of the top portion of the ascending flow passage to at least an upstream side of the ceiling sloping surface of the descending flow passage.

2. The flush toilet according to claim 1, wherein the discharge flow passage includes left and right side surfaces, and the left and right side surfaces are respectively formed to substantially perpendicularly extend in an up-down direction from left and right side portions of the bottom surface of the top portion of the ascending flow passage to left and right side portions of the descending flow passage.

3. The flush toilet according to claim 2, wherein the ceiling sloping surface of the descending flow passage includes an upstream ceiling sloping surface and a downstream ceiling sloping surface, and a curvature radius of a surface connecting the downstream ceiling sloping surface and left and right side surfaces is larger than a curvature radius of a surface connecting the upstream ceiling sloping surface and the left and right side surfaces.

4. The flush toilet according to claim 1, wherein the descending flow passage of the discharge flow passage includes a front bottom surface formed between a lower end of the ceiling sloping surface and a front end of the discharge opening.

5. The flush toilet according to claim 1, wherein the descending flow passage of the discharge flow passage further includes:

a descending bottom surface inclined downward and rearward from a top portion of the ascending flow passage; and a connecting surface that connects a lower end of the descending bottom surface and the upper end of the ceiling sloping surface of the descending flow passage, and a curvature radius in a vertical cross section in a front-rear direction of the connecting surface is smaller than a curvature radius of the descending bottom surface.

6. The flush toilet according to claim 5, wherein length in the front-rear direction from a front end to a rear end of the connecting surface of the descending flow passage is smaller than length in the front-rear direction from a front end to a rear end of the descending bottom surface.

7. The flush toilet according to claim 5, wherein the rear end of the connecting surface of the descending flow passage is located further rearward than a center axis of the discharge opening.

8. The flush toilet according to claim 5, wherein a curvature radius of a connecting surface connecting the descending bottom surface and left and right side surfaces of the descending flow passage is larger than a curvature radius of a connecting surface connecting a bottom surface of an ascending portion of the ascending flow passage and the left and right side surfaces.

9. The flush toilet according to claim 1, wherein the descending flow passage of the discharge flow passage includes a guiding portion formed on the bottom surface thereof, the guiding portion guiding the wastewater flowing horizontally from the bottom surface toward the discharge opening to be directed to either a left or right side of the center of the discharge opening.

* * * * *